US010252092B2

(12) United States Patent
Mataradze et al.

(10) Patent No.: US 10,252,092 B2
(45) Date of Patent: Apr. 9, 2019

(54) EXPLOSION PROTECTION SYSTEM

(71) Applicants: LEPL G. TSULUKIDZE MINING INSTITUTE, Tbilisi (GE); Edgar Mataradze, Tbilisi (GE); Nikoloz Chikhradze, Tbilisi (GE); Theodor Krauthammer, Gainesville, FL (US)

(72) Inventors: Edgar Mataradze, Tbilisi (GE); Nikoloz Chikhradze, Tbilisi (GE); Theodor Krauthammer, Gainesville, FL (US)

(73) Assignee: LEPL G. TSULUKIDZE MINING INSTITUTE, Tbilisi, GA (US)

( * ) Notice: Subject to any disclaimer, the term of this patent is extended or adjusted under 35 U.S.C. 154(b) by 0 days.

(21) Appl. No.: 15/567,172

(22) PCT Filed: Apr. 1, 2016

(86) PCT No.: PCT/GE2016/000004

§ 371 (c)(1),
(2) Date: Oct. 17, 2017

(87) PCT Pub. No.: WO2016/170373

PCT Pub. Date: Oct. 27, 2016

(65) Prior Publication Data

US 2018/0161609 A1 Jun. 14, 2018

(30) Foreign Application Priority Data

Apr. 24, 2015 (GE) ..... AP2015013809

(51) Int. Cl.
*A62C 3/02* (2006.01)
*A62C 37/36* (2006.01)
(Continued)

(52) U.S. Cl.
CPC ..... *A62C 3/0221* (2013.01); *A62C 3/0271* (2013.01); *A62C 37/36* (2013.01);
(Continued)

(58) Field of Classification Search
CPC ..... A62C 3/0221; A62C 3/0271; A62C 37/40; A62C 19/00; A62C 13/70; A62C 13/22; E21F 5/143; E21A 35/023; E21A 35/08
(Continued)

(56) References Cited

U.S. PATENT DOCUMENTS 4,702,322 A * 10/1987 Richardson ..... A62C 35/08 137/68.13
5,069,291 A * 12/1991 O'Connell ..... A62C 35/00 137/68.11

(Continued)

*Primary Examiner* — Christopher Kim
(74) *Attorney, Agent, or Firm* — Abelman, Frayne & Schwab

(57) ABSTRACT

1. Technical effect Increasing the quick action, efficiency and reliability of currently available explosion protection systems. 2. Essence of application The proposed explosion protection system contains an explosion detector and a shock wave damping agent discharge device. The detector consists of overpressure and flame sensors, an identification module and an electromagnetic signal wireless transmitter. The discharge device contains a container filled with damping agent. 3. Field of use Protection of infrastructural and industrial facilities from non-authorized and, terrorist explosions; localization of methane explosion energy in coal mines.

3 Claims, 6 Drawing Sheets

The layout plan of the protection system in the tunnel

(51) Int. Cl.
*E21F 5/14* (2006.01)
*A62C 37/40* (2006.01)

(52) U.S. Cl.
CPC ..... *A62C 37/40* (2013.01); *E21F 5/14* (2013.01); *E21F 5/143* (2013.01)

(58) Field of Classification Search
USPC ..... 169/64, 70, 9, 28, 71, 72, 74, 77, 84, 89
See application file for complete search history.

(56) References Cited

U.S. PATENT DOCUMENTS 5,232,053 A * 8/1993 Gillis ..... A62C 37/40
169/28
5,826,664 A * 10/1998 Richardson ..... A62C 35/08
169/46

* cited by examiner

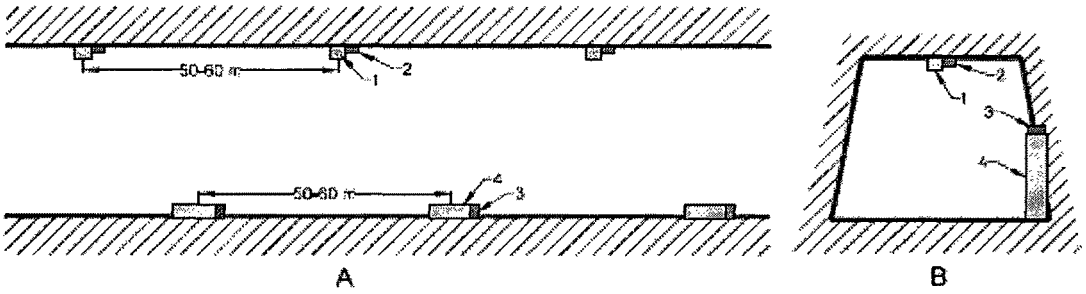
Fig. 1. The layout plan of the protection system in the tunnel

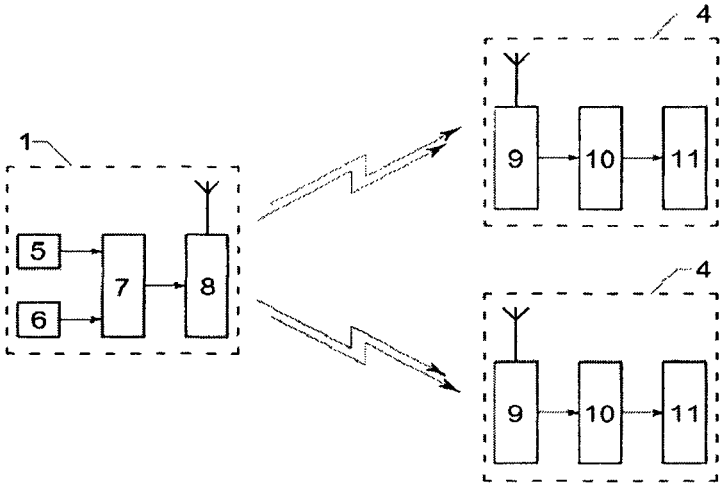
Fig. 2. Electric circuit of system activation

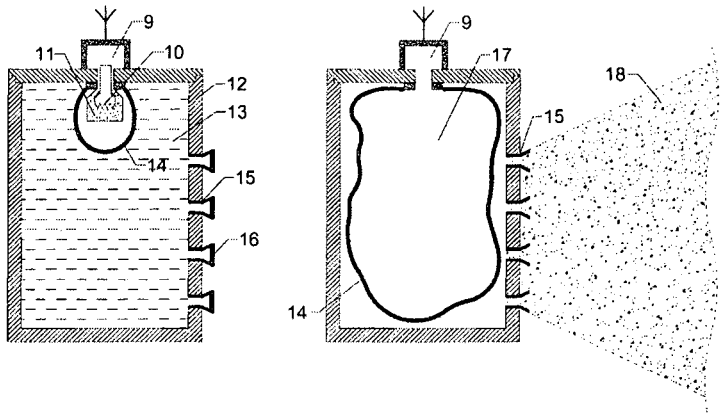
Fig. 3. Principal scheme of liquid suppressing agent discharge device in which spray nozzles are installed on the container wall

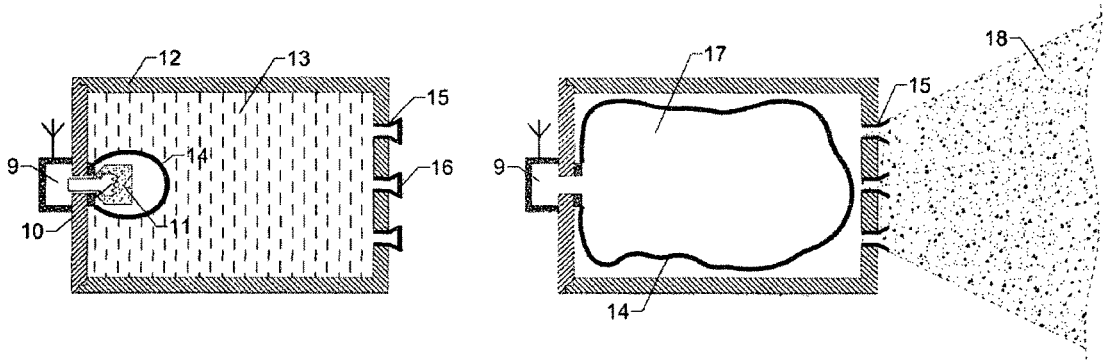
Fig.4. Principal scheme of liquid suppressing agent discharge device in which spray nozzles are installed on the container bottom

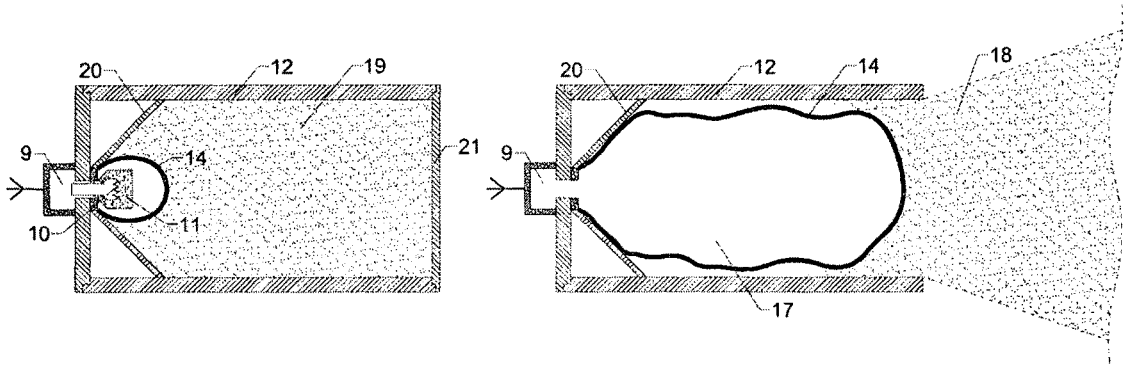
Fig.5. Principal scheme of the inert powder discharge device

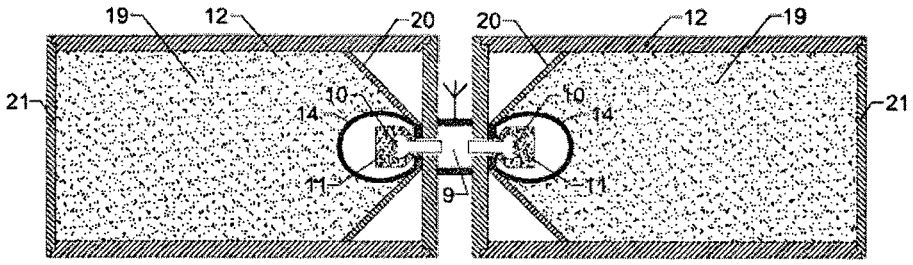
Fig. 6. Principal scheme of inert powder discharge device which contains two containers

EXPLOSION PROTECTION SYSTEM

This invention relates to a security device, namely systems for protecting infrastructural and industrial facilities from unauthorized and terrorist explosions, as well as devices for the localization of methane explosion energy in coal mines.

Presently a variety of explosion protection systems are available. They are characterized by a common principle of operation implying the formation of blast energy suppressing barrier in a zone of air shock wave propagation. The system uses inert powder or water as a quenching agent that disperses immediately upon explosion into the atmosphere of the facility to be protected by means of a special device. It has been proposed that inert powder and water have a high ability of quenching shock wave energy. The proposed device is activated under the immediate impact of a shock wave or by a start electric signal generated by an explosion detector. The detector contains a sensor for registering shock wave generated overpressure and aflame sensor for registering the process of deflagration often taking place at the preliminary stage of methane-air mixture explosion.

The working capacity of the explosion protection system is assessed according to three properties: a)quick action determined by the length of time from the moment of explosion to the creation of extinguishing barrier; b) explosion energy quenching effectiveness determined by ratio of overpressures before and after barrier, as well as according to the efficacy of quenching the flame generated in the process of methane-air mixture deflagration at the preliminary phase of detonation; c) reliability determined by the capacity of the system to exclude the possibility of ignoring the blast or of false activation.

A well-known explosion protection system designed in accordance with the European standards 14591-2:2007 creates energy quenching barrier through the dispersion of water from 40 to 90 liter containers installed on a ceiling or on tunnel walls [1]. The mentioned system has the following disadvantages:

1) it lacks an explosion detector and activates only under the impact created by an explosion on a container, i.e. the protective barrier is formed in a protection zone upon the shock wave arrival; apart from that the process of water discharge from a container takes considerable amount of time (minimum 2-3 sec) which lowers the efficiency of the system;
2) fails to ensure flame localization in the process of deflagration at the initial stage of flame propagation;
3) water discharged from a container is not dispersed which lowers the efficiency of quenching a shock wave. It is known that the quenching capacity of dispersed water several times exceeds that of the water of the same volume;
4) containers installed on a ceiling and walls interfere in the normal functioning of the tunnel.

Analogous to the invention according to technical effect, main design concept and the sphere of application is 'Means of localization of explosions of methane-air mix and (or) coal dust in underground developments and a device for the realization of the task' [2], which is taken as a prototype. According to the prototype, blast energy localization can be achieved by forming inert powder suppressing barrier in a tunnel. The prototype device consists of a framework, a working chamber and cone-shaped bunker filled with inert powder the end part of which is blocked with an easily fragile diaphragm. The working chamber has a stutter by means of which compressed air or inert gas is pumped into a chamber. It also has holes that, at the initial position, are covered with a cylindrical surface of a piston.

The prototype device activates and operates in the following way: an intake valve fixed at the end section of the piston moves the piston under the shock wave impact and opens the working chamber holes from which compressed air or inert gas is supplied to the bunker. As a result, inert powder is dispersed in the tunnel atmosphere forming a suppressing barrier.

In one of the variants of a prototype design a piston has a gas-generating chamber containing an electric initiator, gas-generating chemical substance and an independent power supply source. Such a device is activated in the following way: an electric switch is fixed to the intake valve, which under the shock wave impact generates an electromagnetic signal of certain frequency. The signal is received by an intake installed in the gas-generator's frame, which sends a start electric impulse to the electric initiator of the gas generator. The high-pressure gas formed in the gas-generator during the ignition of chemical substances is supplied to the bunker, as a result of which inert powder is dispersed in the tunnel atmosphere forming a suppressing barrier. Several devices of this type are fixed at regular distances in the protection zone of the tunnel.

The disadvantages of this device:

1. Slow action caused by the need for the piston transposition required for activating the device through opening the working chamber holes and dispersing inert powder from the bunker. The piston has a certain weight and the impact of inert forces retards the transposition of the piston and powder dispersion;
2. Low efficiency as the device activates under the direct impact of the shock wave on the receiving membrane, i.e. at the moment when a shock wave reaches the device. The time from this moment to the formation of a protection barrier makes at least 40-50 ms, and the shock wave propagation reaches 400-600 msec. This means that barrier is formed after shock wave propagates at the distance of 16-30 m from the device, i.e. the mentioned zone of the tunnel is not protected and the device fails to fulfill its main function;
3. Inability to localize flame propagation in the process of methane and air deflagration since the device activates only under the shock wave impact;
4. Low reliability due to difficulty of checking its working capacity without dismantling. Apart from that, many tunnels are affected by high levels of moisture and water inflows causing wetting and consolidation of inert powder. Dispersion of such powder from small diameter holes is either difficult or impossible.
5. Device activation depends on the direction of shock wave propagation. If the shock wave direction is not known, it is necessary to install two devices at one location to ensure barrier formation. One device activates upon the arrival of the shock wave from the right and another, upon the shock wave from the left. This complicates the working conditions and increases costs.

The aforementioned drawbacks affect the quick operation, efficiency and reliability of the device making it inadequate to contemporary requirements.

The purpose of the invention is to increase quick operation, efficiency and reliability of the system. This is achieved by installing a blast and flame detector and shock wave suppressing agent dispersing facility. The blast/flame detector consists of sensors and an emergency electromagnetic signal transmitting device, while the discharge device contains a container filled with shock wave suppressing agent, in which wireless receiver of the electromagnetic signal, electric initiator and pyrotechnic chemical substance are fixed. The detector is attached to the wall or the ceiling of the protection zone of the tunnel. When using liquid agent for suppressing shock wave dispersing nozzles are installed on the walls or the bottom of the container. The outer ends of the dispersing nozzles are blocked with easily dischargeable plugs, while the electric initiator and pyrotechnic chemical substance are located in elastic liquid-proof jacket. When using inert powder for shock wave suppressing the end of the container is blocked with an easily fragile diaphragm; an electric initiator and pyrotechnic chemical substance are placed in an elastic jacket.

The explosion protection system is presented in FIG. 1-6.

FIG. 1 shows the layout plan of the protection system in the tunnel;

FIG. 2—electric circuit of system activation;

FIG. 3—principal scheme of liquid suppressing agent discharge device in which dispersing nozzles are installed on the container wall;

FIG. 4—principal scheme of liquid suppressing agent discharge device in which dispersing nozzles are installed on the container bottom;

FIG. 5—principal scheme of the inert powder discharge device;

FIG. 6—principal scheme of inert powder discharge device which contains two containers.

The protection system contains detectors and suppressing agent discharge devices installed in the protection zone at certain distances (FIG. 1). The detector block (1) is fixed on the surface of the tunnel ceiling or the wall by means of a special fixator (2). The discharge device (4) is installed in a special niche in the tunnel wall or the ceiling by means of clamp (3) so as not to interfere with the normal operation of the tunnel.

The system is activated by means of a wireless device (FIG. 2). The detector (1) contains overpressure (5) and flame (6) sensors, an emergency identification module (7) and an electronic signal transmitter (8). The detector ensures constant monitoring of overpressure and flame in the tunnel. The electronic scheme of the identification module (7) is selected so that an electric impulse generates when overpressure or flame reaches preliminarily determined limit parameters. The transmitter (8) generates an electromagnetic encoded signal of certain frequency in the tunnel immediately upon receiving the electric impulse. The encoded electromagnetic signal is received by the encoded electromagnetic signal receiver (9) installed in the body of the discharge device (4). The receiver immediately sends the electric impulse to the gas-generator's electric initiator (10), which ensures high pressure generation in the discharge device, the suppressing agent discharge in the tunnel and protection barrier formation.

The principal scheme of the liquid suppressing agent discharge device is shown on FIG. 3 and FIG. 4.

The liquid suppressing agent discharge device consists of a container (12) filled with, shock wave suppressing liquid agent (13). An electromagnetic signal wireless receiver (9) is fixed to the outer surface of the body of the container (12) and an elastic liquid-proof jacket (14) containing an electric initiator (10) and pyrotechnic gas-generating chemical substance (11) is fixed on the inner surface of the body. The electric initiator (10) is connected to the receiver (9) by electric conductors. Liquid dispersing nozzles (15) are installed on the container (12) walls (FIG. 3) or on its bottom (FIG. 4), the ends of which are blocked with easily discharged plugs (16). Dispersed water or a mixture of dispersed water and glycerin or the suspension of dispersed water and inert dust can be used as a liquid suppressing agent.

The principal scheme of the inert powder discharge device is shown on FIG. 5. It contains a container (12) filled with shock wave suppressing powder (19). An electromagnetic signal wireless receiver (9) is installed on the container (12) lid's outer surface; a cone-shaped directional (20) and an elastic jacket (14) are attached to the inner surface. In the jacket are placed an electric initiator (10) and pyrotechnic gas-generating chemical substance (11).

The electric initiator (10) is connected by electric conductors to the receiver (9). The end of the container (12) is blocked with an easily fragile diaphragm (21).

FIG. 6 shows a principal scheme of inert powder discharge device which contains two containers. The containers (12) have an electromagnetic signal joint receiver (9), while other elements are analogous with the device shown on FIG. 5.

The protection system operates in the following manner: the protection system installed in the protection zone works in the waiting mode, the duration of which is not limited. The discharge device activates only during explosion or during the combustion of methane-air mixture, as shown on the scheme presented in FIG. 2.

The container (12) of liquid suppressing agent discharge devices (FIG. 3, FIG. 4) is in the initial condition with water or water and glycerin mixture, or water and inert powder suspension, or water and foam-generating reagent.

With the explosion and the initiation of the jacket of the gas-generator (14), the elastic jacket is immediately inflated under the impact of the high-pressure has (17) generated inside. This generates high dynamic pressure in the liquid of the suppressing agent. Under the hydrodynamic pressure impact the outer end plugs (16) of the dispersing nozzles are discharged and the liquid agent jet is discharged from the holes of the discharger at high speed. Nozzles of special design (hole diameter is 1-2 mm and a jet reflecting rod-shaped element is fixed at its external end) are used for dispersing liquid agent. During discharge a mist-like atmosphere (18) is formed the liquid drop diameter in which is less than 1 mm (extinguishing barrier). As is well-known, experimental studies have shown that such atmosphere is characterized by a high capacity of energy suppression.

Inert powder (19) discharges from the container (12) of the inert powder discharging device (FIG. 5) as follows: in the process of immediate inflation of the elastic jacket (14) a dynamic shrinking force is generated in the powder, the impact of which crashes the diaphragm (21), causes the powder mass move at high speed and become discharged in; the atmosphere forming a cloud of powder particles (18) in the protection zone, which creates shock wave extinguishing barrier.

[1] EN 14591-2:2007 Explosion prevention and protection in underground mines—Protective systems—Part 2: Passive water trough barriers.

RU 2342535, E21F5/00 (2006 January). Means of localization of explosions of methane-air mix and (or) coal dust in underground developments and a device for the realization of the task

The invention claimed is:

1. An explosion protection system for protecting a structure having a floor, a wall, and a ceiling, the system comprising a detector fixed on the wall or the ceiling of the protected structure; and a discharge device for discharging a shock wave damping agent, in liquid or inert powder form, and located on the floor, or the wall, or the ceiling of the protected structure at a distance from the detector, wherein the detector contains over pressure and flame sensors, an identification module and a wireless electromagnetic signal transmitter, and wherein the discharge device has a container filled with the damping agent, a wireless electromagnetic signal receiver attached to the container, an electrical initiator and pyrotechnic chemicals located in a liquid or inert powder-proof jacket secured on an inner surface of a container lid, the wireless electromagnetic signal receiver being connected with the electric initiator and the pyrotechnic chemicals by a wire, and dispersing nozzles secured on a wall or a bottom of the container and having outer ends thereof blocked by removable plugs.

2. An explosion protection system according to claim 1, wherein the damping agent is the inert powder form, the jacket is elastic, and the bottom of the container is blocked by a fragile diaphragm.

3. An explosion protection system according to claim 1, wherein the discharge device comprises at least one further container having an electric initiator thereof connected with the wireless electromagnetic receiver, and wherein the container and the at least one further container both discharge jets in a same direction or in an opposite direction, or in a direction at an angle to the same and opposite direction.

* * * * *